US009261844B2

(12) United States Patent
Honda et al.

(10) Patent No.: US 9,261,844 B2
(45) Date of Patent: Feb. 16, 2016

(54) IMAGE FORMING APPARATUS

(71) Applicant: KYOCERA Document Solutions Inc., Osaka-shi, Osaka (JP)

(72) Inventors: Takahiro Honda, Osaka (JP); Kenji Miyamoto, Osaka (JP); Mari Kokomoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/314,253

(22) Filed: Jun. 25, 2014

(65) Prior Publication Data

US 2015/0003883 A1 Jan. 1, 2015

(30) Foreign Application Priority Data

Jun. 28, 2013 (JP) ..... 2013-136331

(51) Int. Cl.

| | |
|---|---|
| ***G03G 15/00*** | (2006.01) |
| ***B65H 29/12*** | (2006.01) |
| ***B65H 43/04*** | (2006.01) |
| ***B65H 85/00*** | (2006.01) |
| *G03G 15/23* | (2006.01) |

(52) U.S. Cl.

CPC ..... *G03G 15/6529* (2013.01); *B65H 29/125* (2013.01); *B65H 43/04* (2013.01); *B65H 85/00* (2013.01); *G03G 15/6576* (2013.01); *B65H 2301/51256* (2013.01); *B65H 2404/1421* (2013.01); *B65H 2511/17* (2013.01); *B65H 2511/414* (2013.01); *B65H 2513/10* (2013.01); *B65H 2515/12* (2013.01); *G03G 15/235* (2013.01); *G03G 2215/00679* (2013.01); *G03G 2215/00683* (2013.01); *G03G 2215/00945* (2013.01); *G03G 2215/00949* (2013.01)

(58) Field of Classification Search

CPC ..... G03G 2215/00662; G03G 2215/00945; G03G 15/6576; G03G 15/235; B65H 23/34

See application file for complete search history.

(56) References Cited

U.S. PATENT DOCUMENTS

| | | | | |
|---|---|---|---|---|
| 5,787,331 | A * | 7/1998 | Ohkuma et al. | 399/406 |
| 5,905,934 | A * | 5/1999 | Koshimizu | 399/396 |
| 2011/0182642 | A1 * | 7/2011 | Nanayama | 399/406 |
| 2012/0237242 | A1 * | 9/2012 | Maeda | 399/67 |

FOREIGN PATENT DOCUMENTS

| | | | |
|---|---|---|---|
| JP | 08217313 | A | 8/1996 |
| JP | 09025040 | A | 1/1997 |
| JP | 2009029554 | A | 2/2009 |
| JP | 2013033156 | A | 2/2013 |

* cited by examiner

*Primary Examiner* — Blake A Tankersley
*Assistant Examiner* — John M Royston
(74) *Attorney, Agent, or Firm* — Alleman Hall McCoy Russell & Tuttle LLP

(57) ABSTRACT

An image forming apparatus according to one aspect of the present disclosure includes an image forming portion, a curling correction portion, and a speed control portion. The image forming portion forms an image on a recording medium. The curling correction portion has one pair of rollers composed of members that respectively have different elasticities and are pressed against each other, and corrects curling that has occurred in the recording medium after image formation performed thereon by the image forming portion, by conveying the recording medium sandwiched with the roller pair. The speed control portion changes a conveyance speed of the recording medium by the roller pair based on a density value of an image formed on the recording medium.

6 Claims, 8 Drawing Sheets

IMAGE FORMING APPARATUS

INCORPORATION BY REFERENCE

This application is based upon and claims the benefit of priority from the corresponding Japanese Patent Application No. 2013-136331 filed on Jun. 28, 2013, the entire contents of which are incorporated herein by reference.

BACKGROUND

The present disclosure relates to an image forming apparatus including a mechanism for correcting curling that has occurred in a recording medium on which an image has been formed.

In image forming apparatuses such as a printer, a copy machine, and a FAX apparatus, toner of a toner image formed on a surface of a print sheet (recording medium) is heated and melted, and further, the print sheet is pressurized, whereby the image is fixed on the print sheet. Since the print sheet after the fixation has been heated, curling may occur upwardly or downwardly in the print sheet. In particular, curling tends to occur in an end portion of the print sheet on the upstream side in the conveying direction thereof and in an end portion of the print sheet on the downstream side in the conveying direction. This curling may cause defective conveyance which results in a jam, defective load of print sheets having been discharged, and the like. Thus, devices that correct curling having occurred in a print sheet have been known. For example, there has been known a curling removing device that can change the direction in which curling is to be corrected based on the curling direction thereof.

SUMMARY

An image forming apparatus according to one aspect of the present disclosure includes an image forming portion, a curling correction portion, and a speed control portion. The image forming portion forms an image on a recording medium. The curling correction portion has one pair of rollers composed of members that respectively have different elasticities and are pressed against each other, and corrects curling that has occurred in the recording medium after image formation performed thereon by the image forming portion, by conveying the recording medium sandwiched with the roller pair. The speed control portion changes a conveyance speed of the recording medium by the roller pair based on a density value of an image formed on the recording medium.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the drawings.

Figure 1:
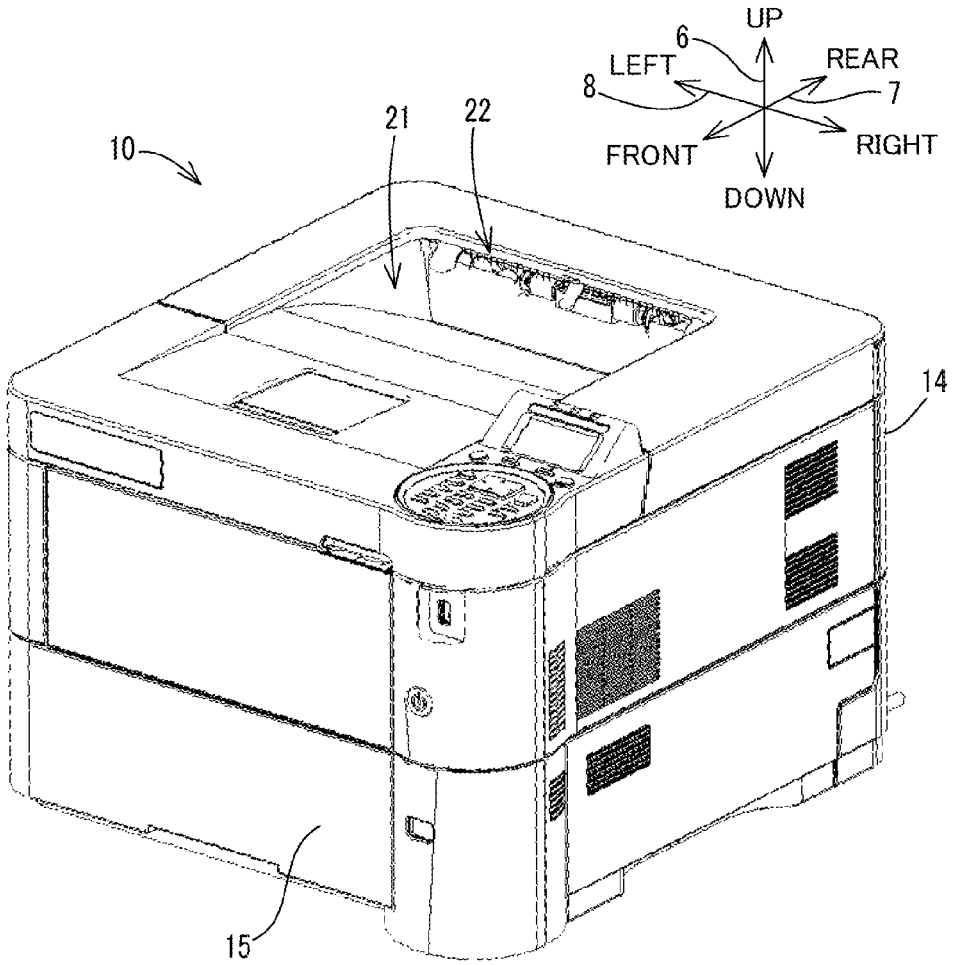
FIG. 1 shows a structure of an image forming apparatus according to an embodiment of the present disclosure.
Figure 2:
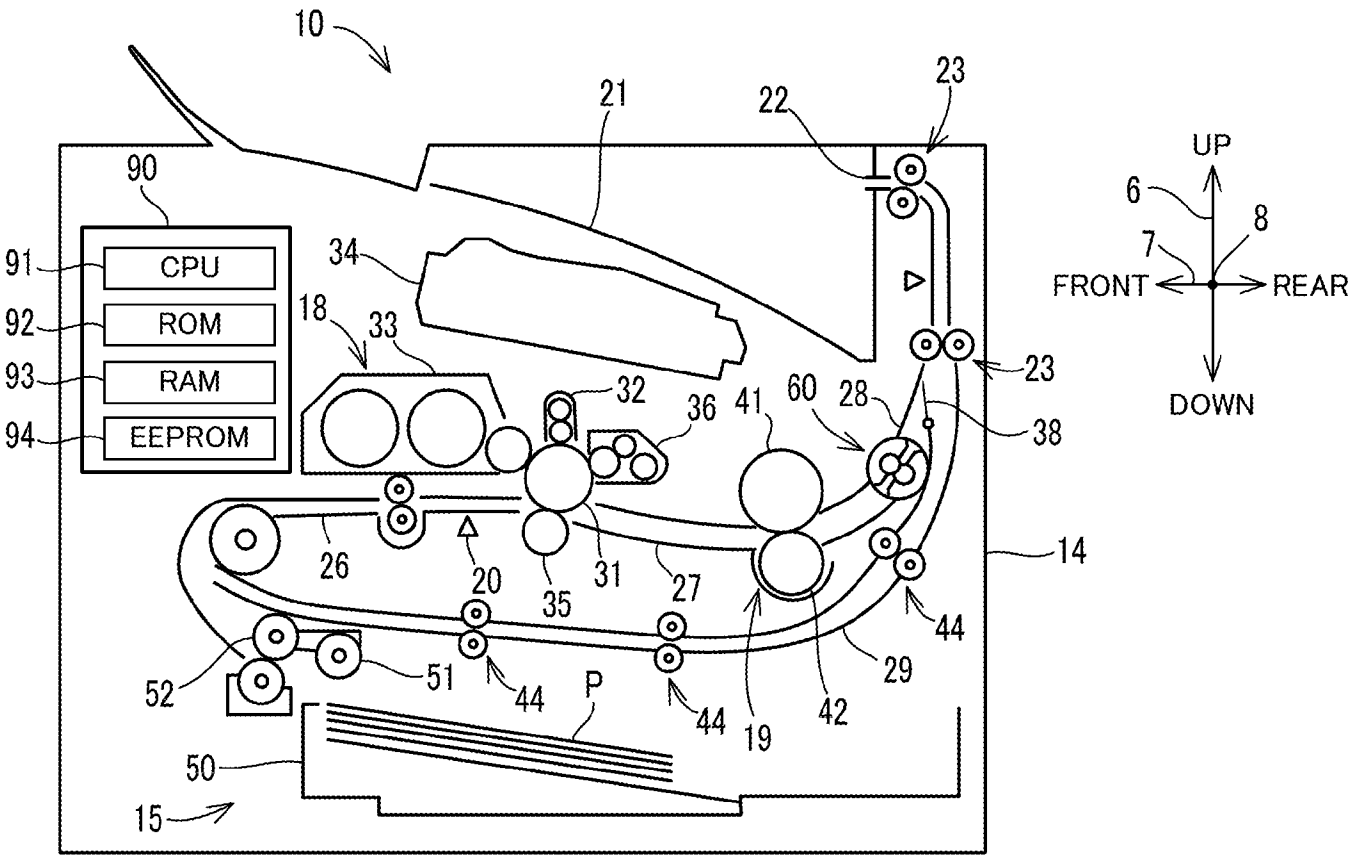
FIG. 2 shows a structure of a cross section of the image forming apparatus shown in FIG. 1.

FIG. 1 and FIG. 2 each show a structure of an image forming apparatus 10 according to an embodiment of the present disclosure. The image forming apparatus 10 is one example of an image forming apparatus of the present disclosure. In the following description, an up-down direction 6 is defined based on a state (the state shown in FIG. 1) in which the image forming apparatus 10 is installed so as to be usable, a front-rear direction 7 is defined with the near side (front face side) set as the front, and a left-right direction 8 is defined when the image forming apparatus 10 is viewed from the near side (front face side).

[Structure of the Image Forming Apparatus 10]

As shown in FIG. 1, the image forming apparatus 10 is a printer. The image forming apparatus 10 prints inputted image data on a print sheet P (one example of recording medium) formed from a vegetable fiber such as pulp, by use of a print material such as toner. The image forming apparatus 10 is not limited to a printer, and the present disclosure is also applicable to a dedicated machine such as a facsimile or a copy machine.

The image forming apparatus 10 prints an image on a print sheet P based on image data inputted from the outside via a network communication portion not shown. For example, upon receiving a printing job from an apparatus such as a personal computer, the image forming apparatus 10 prints an image on a print sheet P based on image data and a printing condition indicated by the printing job. Alternatively, the image forming apparatus 10 prints an image on a print sheet P based on image data read by a scanner not shown.

As shown in FIG. 1 and FIG. 2, the image forming apparatus 10 mainly includes an image forming portion 18 (one example of an image forming portion of the present disclosure) of an electrophotographic type, a fixing portion 19, a sheet feed device 15, a curling correction portion 60 (one example of a curling correction portion of the present disclosure), a paper sheet sensor 20, a control portion 90, and the like. The image forming apparatus 10 also includes a conveyance motor 56 and a discharge motor 57 (see FIG. 5). These are disposed inside a housing 14 which forms a cover of the outer frame and an inner frame 16 (see FIG. 4) of the image forming apparatus 10.

As shown in FIG. 2, the sheet feed device 15 is provided in a lowermost part of the image forming apparatus 10. The sheet feed device 15 includes a paper sheet tray 50, a pickup roller 51, and a sheet feed roller 52. The paper sheet tray 50 accommodates a print sheet P onto which an image is formed by the image forming portion 18. The paper sheet tray 50 is supported by the housing 14. The pickup roller 51 and the sheet feed roller 52 are provided in a front and upper part of the paper sheet tray 50. Upon input of an instruction for the image forming apparatus 10 to start a sheet feeding operation of a print sheet P, the conveyance motor 56 (see FIG. 5) is driven to rotate. Accordingly, the pickup roller 51 and the sheet feed roller 52 are rotated. Then, the print sheet P is fed from the paper sheet tray 50 by the pickup roller 51. The print sheet P fed by the pickup roller 51 is conveyed to the downstream side in the feed direction of the print sheet P by the sheet feed roller 52. Specifically, when the print sheet P is sent out upwardly by the sheet feed roller 52, the print sheet P passes through a conveyance path 26 extending from the sheet feed roller 52 to the image forming portion 18, and thus its feeding direction is changed to the backward (rear side of the image forming apparatus 10), and then is conveyed toward the image forming portion 18.

The conveyance path 26 is provided with the paper sheet sensor 20. In detail, the paper sheet sensor 20 is disposed, in the conveyance path 26, upstream of a transfer portion 35 of the image forming portion 18. The paper sheet sensor 20 detects the leading end of the print sheet P passing through the conveyance path 26, and is, for example, a light sensor of a light-emitting type. When the leading end of the print sheet P passes a position, in the conveyance path 26, that corresponds to the arrangement position of the paper sheet sensor 20, a signal to be outputted from the paper sheet sensor 20 to the control portion 90 is changed. By receiving this change in the signal, the control portion 90 can determine the position of the leading end of the print sheet P.

Based on the inputted image data, the image forming portion 18 forms an image on the print sheet P. The image forming portion 18 transfers a toner image on the print sheet P by use of a print material such as toner. Specifically, as shown in FIG. 2, the image forming portion 18 includes a photosensitive drum 31, a charging portion 32, a developing portion 33, an LSU (Laser Scanning Unit) 34, the transfer portion 35, and a cleaning portion 36. The photosensitive drum 31 is disposed above the conveyance path 26. Upon start of an image forming operation, the surface of the photosensitive drum 31 is charged at a uniform potential by the charging portion 32. Further, the LSU 34 scans the photosensitive drum 31 with a laser beam in accordance with the image data. As a result, an electrostatic latent image is formed on the photosensitive drum 31. Then, toner is adhered to the electrostatic latent image by the developing portion 33, and the toner image is formed on the photosensitive drum 31. Then, the toner image is transferred, by the transfer portion 35, to the print sheet P conveyed through the conveyance path 26. The print sheet P on which the toner image has been transferred is sent out to a conveyance path 27 extending from the image forming portion 18 to the fixing portion 19. Then, the print sheet P is conveyed to the fixing portion 19 disposed downstream (i.e., to the rear side) of the image forming portion 18, in the conveying direction of the print sheet P.

The fixing portion 19 fixes the toner image transferred to the print sheet P, onto the print sheet P with heat. The fixing portion 19 includes a heating roller 41 and a pressurizing roller 42. The pressurizing roller 42 is urged toward the heating roller 41 side by means of an elastic member such as a spring. Accordingly, the pressurizing roller 42 is pressed against the heating roller 41. The heating roller 41 is heated to high temperature by a heating device such as a heater during the fixing operation. While the print sheet P passes through the fixing portion 19, the toner forming the toner image is heated to melt by the heating roller 41, and further the print sheet P is pressurized by the pressurizing roller 42. As a result, the toner is fixed on the print sheet P by the fixing portion 19. Accordingly, the toner image is fixed on the print sheet P, whereby an image is formed on the print sheet P.

In the fixing portion 19, the print sheet P is conveyed while being heated to high temperature and pressurized. This may cause curling of the print sheet P. Curling includes upward curling toward the upper surface side of the print sheet P and downward curling toward the lower surface side of the print sheet P, when viewed in FIG. 2. The direction of curling changes depending on, for example, the density of the image formed on the print sheet P, that is, the amount of toner fixed on the print sheet P. For example, in a case where one-side printing in which an image is formed on only one side of a print sheet P, is performed, toner is fixed on only one side thereof. Therefore, when the melted toner hardens, the print sheet P tends to curl toward the image formation surface on which the toner has been fixed. When double-sided printing in which images are formed on both sides of a print sheet P, is performed, the direction of curling changes depending on the densities of the images on the respective surfaces. For example, the print sheet P tends to curl toward a surface having a high density, that is, toward a surface on which the amount of toner is large. The magnitude of curling tends to be greater as the image density is higher, and tends to be smaller as the image density is lower. It should be noted that the curling of the print sheet P is corrected by the curling correction portion 60 described below provided in a conveyance path 28.

The conveyance path 28 is provided downstream of the fixing portion 19, in the conveying direction of the print sheet P. At the terminal end of the conveyance path 28, a sheet outlet 22 through which the print sheet P is discharged is provided. That is, the conveyance path 28 is provided from the fixing portion 19 to the sheet outlet 22. The print sheet P on which an image has been fixed by the fixing portion 19 is conveyed into the conveyance path 28. The conveyance path 28 is curved upwardly from the fixing portion 19 and then extends straight upwardly in the vertical direction. The conveyance path 28 is provided with a plurality of discharge roller pairs 23 to be rotated in either direction by the discharge motor 57 (see FIG. 5). The print sheet P conveyed into the conveyance path 28 is conveyed upwardly through the conveyance path 28 by the discharge roller pairs 23 which are caused to operate in forward rotation by the discharge motor 57, and then is discharged from the sheet outlet 22 into a sheet discharge portion 21 provided on the upper surface of the image forming apparatus 10.

When one-side printing is performed in the image forming apparatus 10, the print sheet P having an image formed on one side thereof sequentially passes through the fixing portion 19 and the curling correction portion 60, and then passes through the conveyance path 28 to be discharged from the sheet outlet 22.

On the other hand, when double-sided printing is performed in the image forming apparatus 10, the print sheet P first having an image formed on one side thereof passes through the fixing portion 19 and the curling correction portion 60, and then is again conveyed from the upstream side in the conveying direction of the print sheet P, into the reverse direction, with the front and back sides of the print sheet P reversed. In detail, in a state where the leading end of the print sheet P having an image formed on one side thereof is exposed from the sheet outlet 22 to the outside, rotation of the discharge roller pairs 23 are stopped. At this time, the trailing end of the print sheet P is held while being sandwiched by the discharge roller pair 23 that is near the sheet outlet 22. Thereafter, the discharge roller pairs 23 are rotated reversely by reverse rotation drive of the discharge motor 57 (see FIG. 5), whereby the print sheet P is again conveyed in the conveyance path 28 in the reverse direction. That is, the print sheet P is reversely conveyed in the conveyance path 28. As shown in FIG. 2, the image forming apparatus 10 is provided with a reverse conveyance path 29 which branches from the conveyance path 28 and connects to a part of the conveyance path 26. The part is on the upstream side in the conveying direction of the print sheet P when viewed from the image forming portion 18. At the branch point between the conveyance path 28 and conveyance path 29, a flap 38 is provided which has a film-like shape and which guides the print sheet P being reversely conveyed, into the reverse conveyance path 29. The print sheet P reversely conveyed in the conveyance path 28 is guided by the flap 38 from the conveyance path 28 into the reverse conveyance path 29. The reverse conveyance path 29 is provided with a plurality of conveyance roller pairs 44. The print sheet P passes through the reverse conveyance path 29 by means of the conveyance roller pairs 44, to be conveyed to the image forming portion 18 again via the conveyance path 26. The print sheet P having reached the image forming portion 18 passes through the image forming portion 18 and the fixing portion 19, whereby an image is formed on the opposite side surface thereof where no image has been formed. Thereafter, the print sheet P having images formed on both sides thereof passes through the curling correction portion 60, then passes through the conveyance path 28 by means of the discharge roller pairs 23 having returned to operate in forward rotation, and then, is discharged from the sheet outlet 22 to the sheet discharge portion 21. The reverse conveyance path 29 and the conveyance roller pairs 44 for conveying the print sheet P again to the upstream side of the image forming portion 18 with the front and back sides of the print sheet P reversed are one example of a reverse conveyance portion of the present disclosure.

[The Curling Correction Portion 60]

Figure 3B:
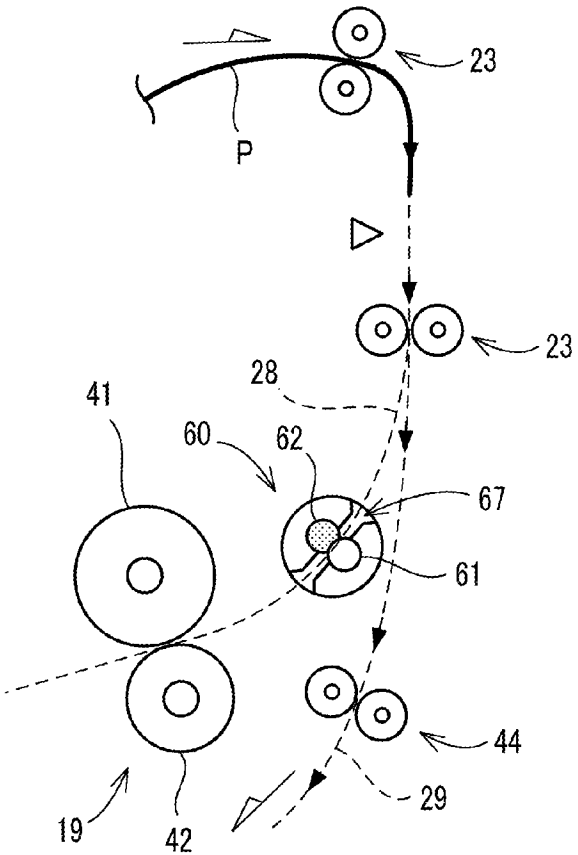
FIG. 3A and FIG. 3B each show a structure of a vicinity of a curling correction portion of the image forming apparatus shown in FIG. 1.
Figure 3A:
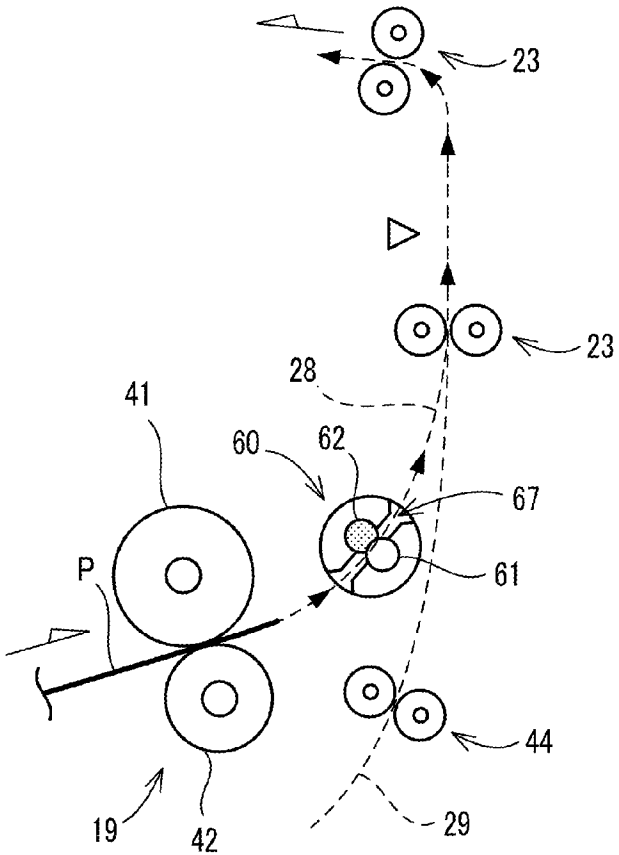

Next, the structure of the curling correction portion 60 will be specifically described. As shown in FIG. 3A and FIG. 3B, the curling correction portion 60 is provided in the conveyance path 28. More in detail, the curling correction portion 60 is provided, in the conveyance path 28, between the fixing portion 19 and the branch point of the reverse conveyance path 29. The curling correction portion 60 corrects curling that has occurred in a print sheet P after the image formation performed thereon by the image forming portion 18 and the fixing portion 19.

Figure 4:
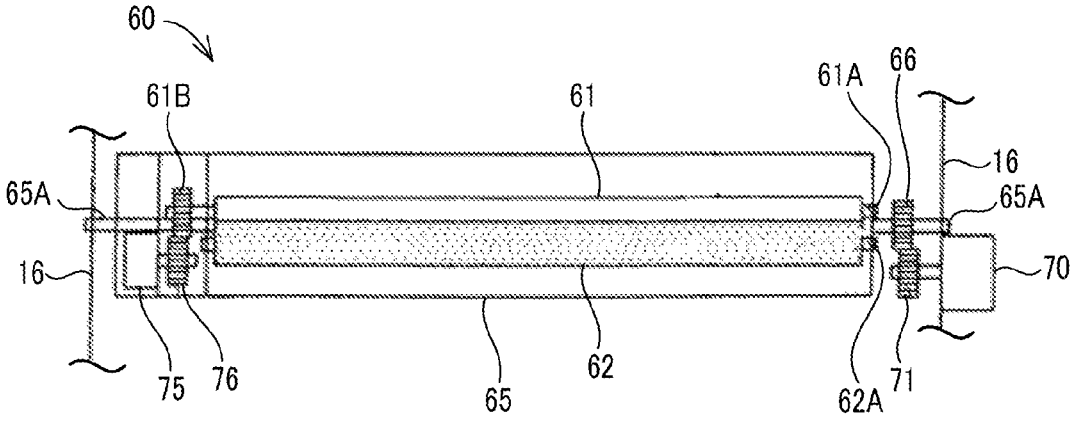
FIG. 4 shows a structure of the curling correction portion of the image forming apparatus shown in FIG. 1.

As shown in FIG. 4, the curling correction portion 60 includes a hard roller 61, a soft roller 62, and a casing 65. The hard roller 61 and the soft roller 62 are one example of one roller pair of the present disclosure. The hard roller 61 and the soft roller 62 are respectively formed from members having different elasticities, and are pressed against each other. When the print sheet P having an image formed thereon by the image forming portion 18 and the fixing portion 19 advances the portion where the hard roller 61 and the soft roller 62 are pressed against each other, the hard roller 61 and the soft roller 62 sandwich the print sheet P and convey it. Accordingly, curling that has occurred in the print sheet P is corrected.

The hard roller 61 is made of material harder than that of the soft roller 62, i.e., for example, a hard material such as metal. The soft roller 62 is made of a flexible material such as synthetic resin. The casing 65 houses the hard roller 61 and the soft roller 62. A shaft 61A of the hard roller 61 and a shaft 62A of the soft roller 62 are parallel to each other. Each of the shafts 61A and 62A is rotatably supported by a bearing (not shown) provided in the casing 65. The periphery of the soft roller 62 is pressed against the periphery of the hard roller 61.

In the casing 65, a conveyance path 67 extending in the diameter direction thereof (see FIG. 3A and FIG. 3B) is formed. The conveyance path 67 is formed in a size and a width that allow a curled print sheet P to advance therethrough. The openings which are on both sides of the conveyance path 67 and which serve as an inlet and an outlet for the print sheet P to and from the conveyance path 67 are each formed in a funnel-like diverging shape. In a middle portion of the conveyance path 67, the hard roller 61 and the soft roller 62 protrude so as to be pressed against each other.

The curling correction portion 60 is rotatably supported about a shaft 65A which is parallel to the shafts 61A and 62A, so as to be capable of reversing arrangement of the hard roller 61 and the soft roller 62. Specifically, the casing 65 of the curling correction portion 60 is rotatably supported relative to the inner frame 16 of the image forming apparatus 10, by means of the shafts 65A which are provided at the center of the casing 65 and which extends outwardly from both sides thereof. Accordingly, the curling correction portion 60 is rotatable about the shaft 65A.

To one of the shaft 65A, a gear 66 is mounted. To the inner frame 16, a casing rotation motor 70 (one example of a drive portion of the present disclosure) is mounted. The casing rotation motor 70 rotates the curling correction portion 60 about the shaft 65A. To the output shaft of the casing rotation motor 70, a gear 71 is mounted, and the gear 71 is meshed with the gear 66. Accordingly, when the casing rotation motor 70 is driven to rotate, the casing 65 is rotated about the shaft 65A, with the hard roller 61 and the soft roller 62 housed therein.

To one end portion of the shaft 61A of the hard roller 61, a gear 61B is mounted. To the casing 65 a hard roller rotation motor 75 is mounted. The hard roller rotation motor 75 rotates the hard roller 61 about the shaft 61A. To the output shaft of the hard roller rotation motor 75, a gear 76 is mounted, and the gear 76 is meshed with the gear 61B. Accordingly, when the hard roller rotation motor 75 is driven to rotate, the hard roller 61 is rotated.

As described above, the soft roller 62 is rotatably supported relative to the casing 65 and is pressed against the hard roller 61. Thus, the soft roller 62 is rotated so as to follow (rotated together with) the rotation of the hard roller 61. In the present embodiment, of the one pair of rollers, only the hard roller 61 is supplied with drive force. Thus, compared with a structure in which both the hard roller 61 and the soft roller 62 are supplied with drive force to rotate, the structure of the present embodiment is simple. The hard roller rotation motor 75 being the drive source is provided inside the casing 65, and thus, also from this point, the structure of the present embodiment is compact and simple.

Further, the curling correction portion 60 also has a function of guiding conveyance of the print sheet P. Thus, as shown in FIG. 3A and FIG. 3B, the curling correction portion 60 is provided downstream of the fixing portion 19 in the conveying direction of the print sheet P. The print sheet P having been conveyed from the fixing portion 19 advances into the conveyance path 67 in the casing 65, and is further conveyed to the downstream side in the conveying direction of the print sheet P while being sandwiched by the hard roller 61 and the soft roller 62.

As described above, the curling correction portion 60 is rotatably supported about the shaft 65A so as to be capable of reversing arrangement of the hard roller 61 and the soft roller 62. In the present embodiment, when a curling correction process described later is executed by the control portion 90, the curling correction portion 60 is rotated between a first position and a second position which are determined in advance. Specifically, the curling correction portion 60 is rotated between the first position at which the soft roller 62 is positioned on the heating roller 41 side (the position shown in FIG. 3A and FIG. 3B), and the second position at which the hard roller 61 is positioned on the heating roller 41 side (the position obtained by rotating about the shaft 65A by 180 degrees from the first position). The curling correction process will be described later.

[Configuration of the Control Portion 90]

The control portion 90 performs overall control of the image forming apparatus 10. As shown in FIG. 2, the control portion 90 includes a CPU 91, a ROM 92, a RAM 93, an EEPROM 94, and the like. It should be noted that the control portion 90 may be structured as an electronic circuit such as an integrated circuit (ASIC, DSP).

Figure 5:
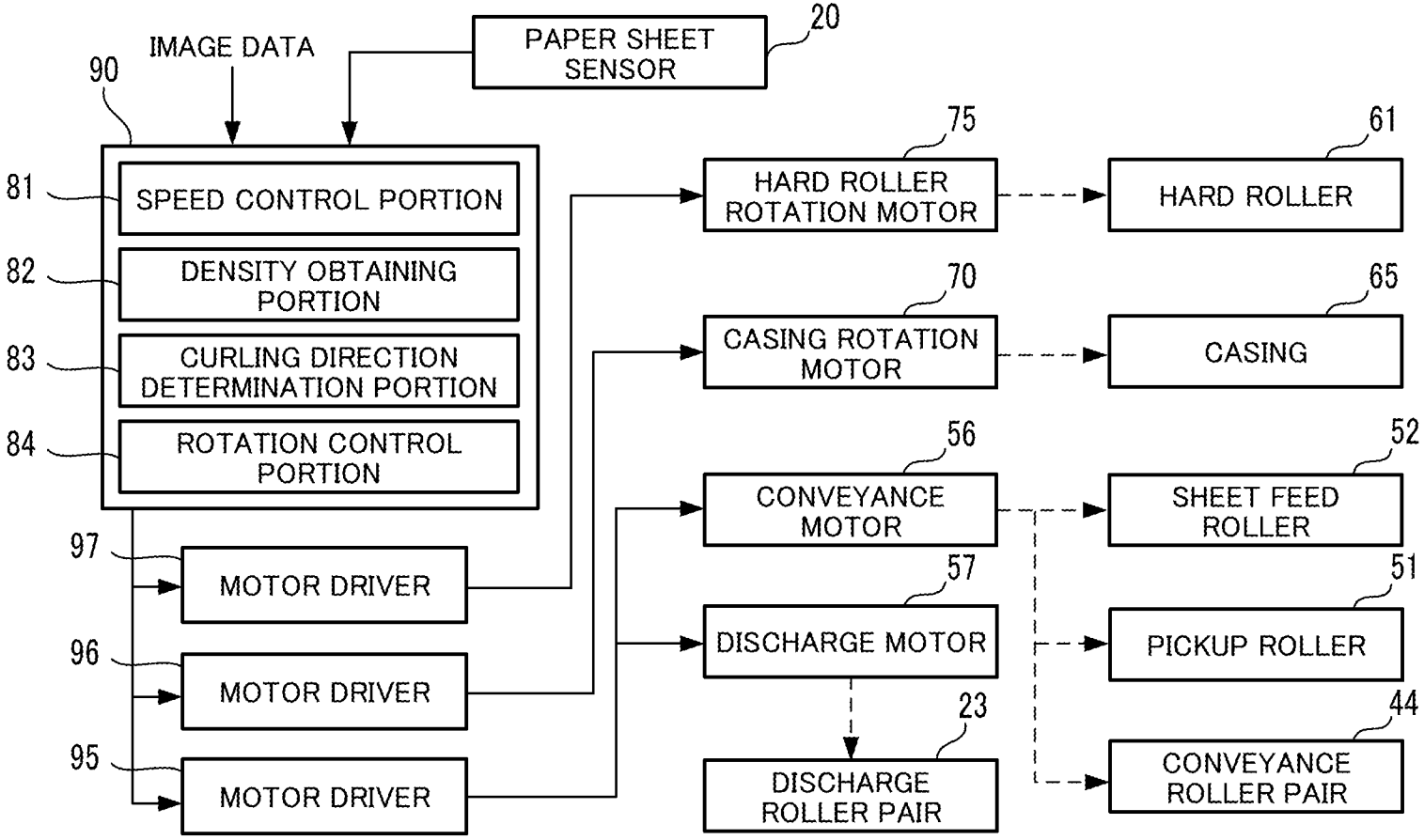
FIG. 5 is a block diagram showing a configuration of a control portion of the image forming apparatus shown in FIG. 1.

The control portion 90 is connected to the image forming portion 18, the fixing portion 19, the sheet feed device 15, and the like, inside the image forming apparatus 10, and controls these components. Also, as shown in FIG. 5, the control portion 90 is connected to motor drivers 95 to 97. The motor driver 95 controls a rotation direction and a rotation speed of each of the conveyance motor 56 and the discharge motor 57, upon receiving a control signal from the control portion 90. The motor driver 96 controls a rotation direction and a rotation speed of the casing rotation motor 70, upon receiving a control signal from the control portion 90. The motor driver 97 controls a rotation direction and a rotation speed of the hard roller rotation motor 75, upon receiving a control signal from the control portion 90.

In the present embodiment, the control portion 90 functions as a speed control portion 81, a density obtaining portion 82, a curling direction determination portion 83, and a rotation control portion 84 (see FIG. 5) by a control program in the ROM 92 being executed by the CPU 91.

The speed control portion 81 controls drive of the hard roller rotation motor 75 via the motor driver 97. The speed control portion 81 changes the conveyance speed of the print sheet P by one roller pair composed of the hard roller 61 and the soft roller 62 included in the curling correction portion 60, based on a density value of an image formed on the print sheet P. Specifically, when a density value of an image is greater than or equal to a reference value determined in advance, the speed control portion 81 changes the conveyance speed of the print sheet P by the hard roller 61 and the soft roller 62 to a first speed V1 determined in advance. When a density value of an image is less than the reference value, the speed control portion 81 changes the conveyance speed of the print sheet P by the hard roller 61 and the soft roller 62, to a second speed V2 which is faster than the first speed V1. It should be noted that information regarding the first speed V1 and the second speed V2 is stored in the EEPROM 94.

Figure 6:
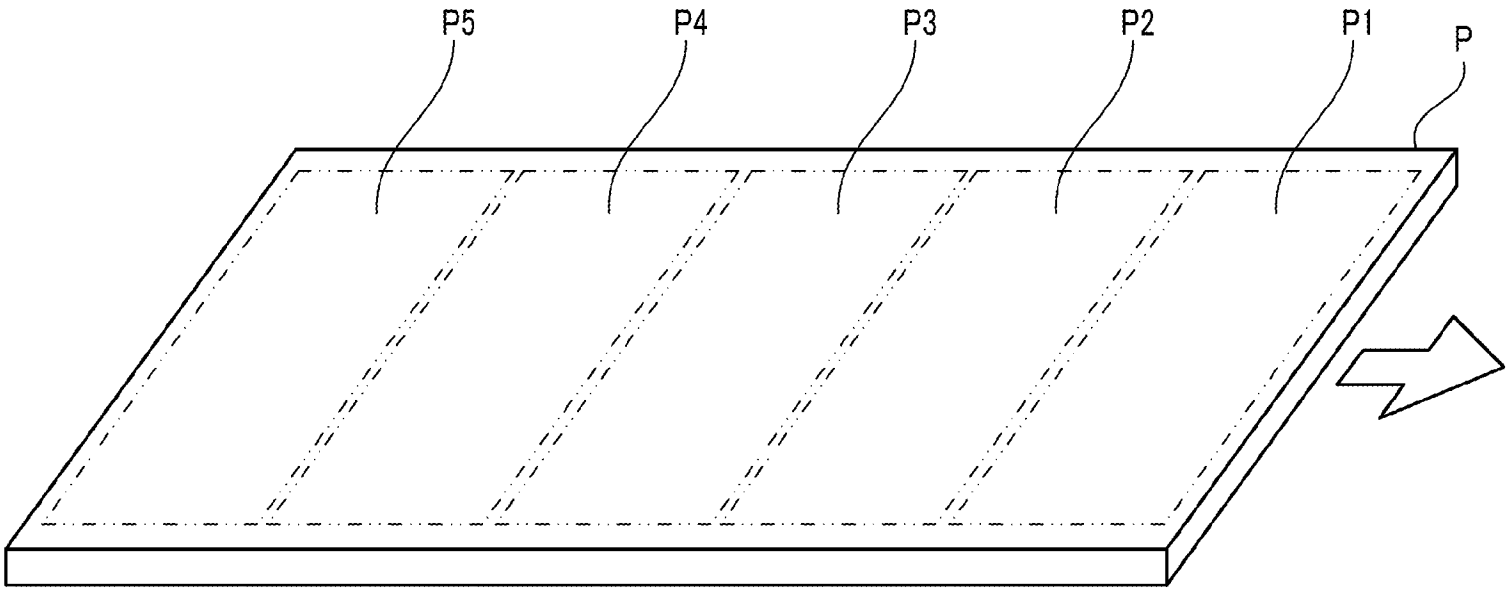
FIG. 6 illustrates division areas on a print sheet whose density values are obtained by the control portion shown in FIG. 5.

The density obtaining portion 82 measures a density value of an image for each of areas P1 to P5 (see FIG. 6, one example of division areas of the present disclosure) obtained by dividing an image formation surface of the print sheet P into a plurality of areas. Accordingly, the density obtaining portion 82 obtains a density value of an image for each of the areas P1 to P5. For example, in a case where a plurality of areas, i.e., the areas P1 to P5, are defined in the print sheet P shown in FIG. 6, the areas P1 to P5 being obtained by dividing the print sheet P into five, from the end portion on the downstream side in the conveying direction (the direction of the white arrow) by the hard roller 61 and the soft roller 62 of the curling correction portion 60 toward the end portion on the upstream side thereof, the density obtaining portion 82 obtains a density value of an image for each of the areas P1 to P5. The density value of each image can be obtained from image data inputted at the time of image formation. Here, the portions each surrounded by a dash-double-dot line in FIG. 6 are the areas P1 to P5.

It should be noted that the speed control portion 81 changes the conveyance speed of the print sheet P at the time when each of the areas P1 to P5 is conveyed by the hard roller 61 and the soft roller 62, based on a density value of an image of each of the areas P1 to P5 obtained by the density obtaining portion 82.

The curling direction determination portion 83 determines the direction of curling of the print sheet P after the image formation has been performed. In a case where one-side printing is performed, an image is formed only on the image formation surface by the one-side printing. Thus, the curling direction determination portion 83 determines that the print sheet P curls toward the surface on which the image has been formed. In a case where double-sided printing is performed, the curling direction determination portion 83 determines that the print sheet P curls toward a surface, of both surfaces on which images have been formed, that has a higher image density. Since the curling direction determination portion 83 can obtain image densities of respective surfaces from the inputted image data, the curling direction determination portion 83 determines the surface having a higher image density by comparing the image data of the respective surfaces with each other, and thus can determine that the print sheet P curls toward that surface having a higher image density.

The rotation control portion 84 controls drive of the casing rotation motor 70 via the motor driver 96. Specifically, the rotation control portion 84 rotates the casing 65 of the curling correction portion 60 to either one of the first position and the second position at which the curling correction portion 60 can correct curling of the print sheet P into a direction reverse to the direction of the curling determined by the curling direction determination portion 83.

[Curling Correction Process]

Figure 7:
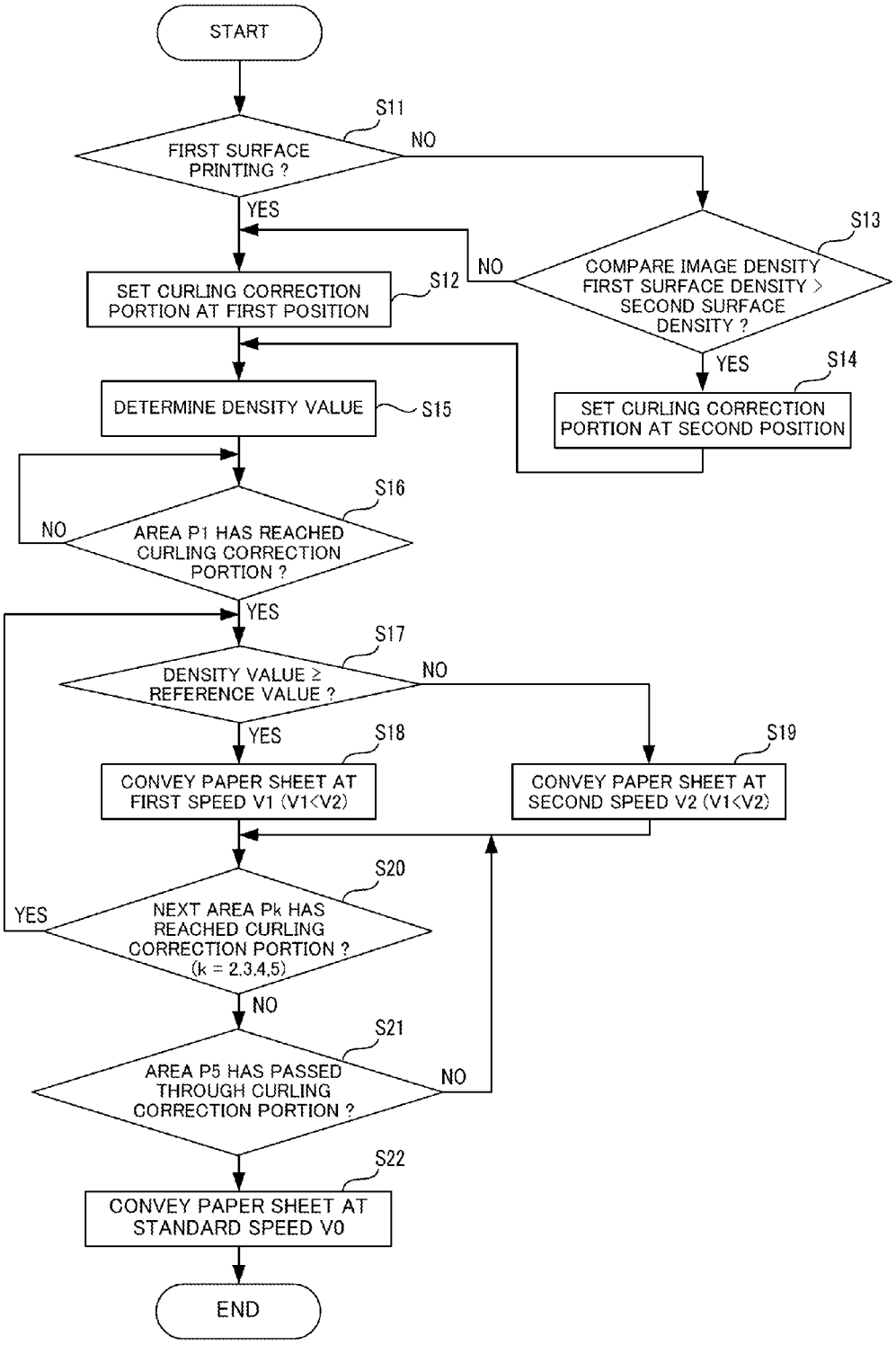
FIG. 7 is a flow chart showing one example of a curling correction process executed by the control portion shown in FIG. 5.
Figure 8A:
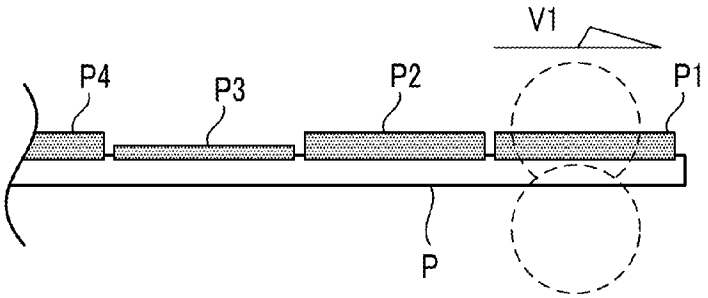
FIG. 8A to FIG. 8C each show a state of conveyance of a print sheet in the curling correction portion shown in FIG. 4.
Figure 8B:
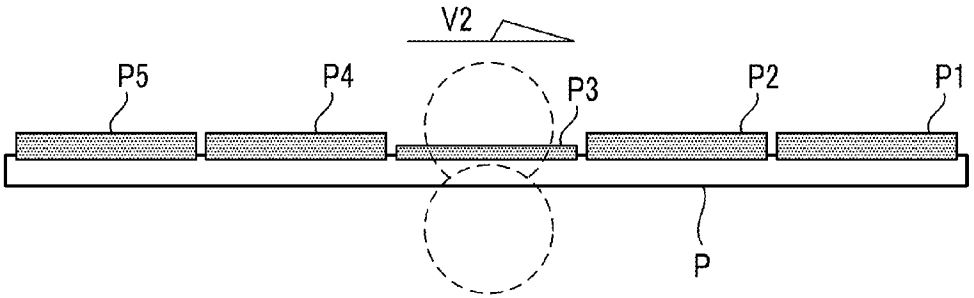
Figure 8C:
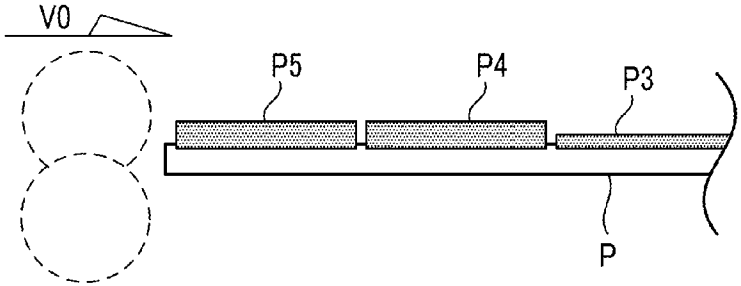

In the following, with reference to FIG. 8A to FIG. 8C, a procedure of the curling correction process to be executed by the control portion 90 will be described by use of the flow chart shown in FIG. 7. Here, FIG. 8A shows a state where the area P1 is being conveyed in the curling correction portion 60. FIG. 8B shows a state where the area P3 is being conveyed in the curling correction portion 60. FIG. 8C shows a state where the area P5 has passed through the curling correction portion 60. It should be noted that, in FIG. 8A to FIG. 8C, the shaded part in each area represents an image, and the thickness of the shaded part represents an image density. Moreover, S11, S12, . . . in FIG. 7 represent process procedure (step) numbers. By the curling correction process being executed by the control portion 90 in accordance with the procedure, the position of the curling correction portion 60 can be changed, and further, curling of the print sheet P can be assuredly removed by the curling correction portion 60 whose position has been changed. In the following description, it is assumed that the image forming apparatus 10 is in a state where an instruction to form an image and image data have been inputted in the image forming apparatus 10. Moreover, the surface on which an image is formed during one-side printing, and the surface on which an image is firstly formed during double-sided printing will be referred to as a first surface. The surface on which an image is formed for the second time during double-sided printing will be referred to as a second surface.

In step S11, the control portion 90 determines whether the next image forming process is first surface printing. Here, the first surface printing is an image forming process performed onto the first surface. The determination process in step S11 is a process for determining the direction of curling that occurs when an image is formed on the print sheet P. In the present embodiment, when the image forming process is the first surface printing, it is determined that curling occurs toward the image formation surface side, and when the image forming process is not the first surface printing, it is determined that curling occurs toward the second surface side being the back side of the image formation surface. The control portion 90 performing this determination is one example of a curling direction determination portion of the present disclosure.

Specifically, in step S11, in a case where a printing job inputted from the outside includes an instruction to perform one-side printing, the control portion 90 determines that the image forming process is the first surface printing. Also, in a case where an instruction to perform one-side printing has been inputted along with image data from a scanner not shown, the control portion 90 determines that the image forming process is the first surface printing. Even in a case where an instruction to perform double-sided printing has been inputted, when operation of forming an image is performed for the first time, the control portion 90 determines that the image forming process is the first surface printing.

Upon determining that the image forming process is the first surface printing in step S11, the control portion 90 causes the curling correction portion 60 to be positioned at the first position (the position shown in FIG. 3) in step S12. Specifically, the control portion 90 supplies a control signal to the motor driver 96 to drive the casing rotation motor 70. By this, the control portion 90 causes the casing 65 to rotate and causes the curling correction portion 60 to rotate to the first position. Then, the control portion 90 shifts the process to step S15.

Upon determining that the image forming process is not the first surface printing in step S11, the control portion 90 compares the image density of the first surface and the image density of the second surface in step S13. Here, the case where the image forming process is not the first surface printing is a case where an instruction to perform double-sided printing has been inputted and the second surface printing in which an image is formed for the second time (an image forming process onto the second surface) is performed. In this case, image data of an image to be formed on the first surface and image data of an image to be formed on the second surface have been inputted in the image forming apparatus 10. Thus, the control portion 90 determines, through comparison, which surface has a higher image density value based on image density information contained in their respective image data. Here, in a case where the image density of the first surface is higher, even if image formation onto the second surface is performed, the print sheet P tends to curl toward the first surface side. In this case, the print sheet P has been reversed by means of the reverse conveyance path 29 before the second surface printing is performed. Thus, the print sheet P being conveyed in the conveyance path 28 after the second surface printing has curled toward the first surface side, that is, downwardly when viewed in FIG. 2. Therefore, when having determined that the image density of the first surface is higher in step S13, the control portion 90 causes the curling correction portion 60 to be positioned at the second position (the position where the hard roller 61 is positioned on the heating roller 41 side) (S14). Specifically, the control portion 90 supplies a control signal to the motor driver 96 to drive the casing rotation motor 70. By this, the control portion 90 causes the casing 65 to rotate and causes the curling correction portion 60 to rotate to the second position. On the other hand, in a case where the image density of the second surface is higher, by image formation onto the second surface being performed, the print sheet P tends to curl toward the second surface side. Thus, the print sheet P being conveyed in the conveyance path 28 after the second surface printing has curled toward the second surface side, that is, upwardly when viewed in FIG. 2. Therefore, when having determined that the image density of the second surface is higher in step S13, the control portion 90 causes the curling correction portion 60 to be positioned at the first position (the position where the soft roller 62 is positioned on the heating roller 41 side) (S12), and shifts the process to step S15. It should be noted that the control portion 90 which performs rotation control to cause the curling correction portion 60 to rotate to the first position or the second position is one example of a rotation control portion of the present disclosure.

Next, in step S15, the control portion 90 determines the density value of the image to be formed on the image formation surface of the print sheet P. Specifically, the control portion 90 obtains a density value for each of the areas P1 to P5 shown in FIG. 6, from density information contained in the image data. As the method for obtaining each density value, various methods can be employed. For example, the density value may be obtained based on a dot count value counted during image formation. In a case where a density sensor is provided which detects the density of a sheet surface after image formation, the density value may be obtained based on an output signal from the density sensor. It should be noted that the control portion 90 which determines the density value in step S15 is one example of a density obtaining portion of the present disclosure.

In the next step 16, the control portion 90 determines whether the area P1 at the head of the print sheet P in the conveying direction has reached the curling correction portion 60. Specifically, in a case where the print sheet P has been conveyed by a distance from the position of the leading end of the print sheet P detected based on a signal from the paper sheet sensor 20 to the curling correction portion 60, the control portion 90 determines that the area P1 has reached the curling correction portion 60 based on the amount of the conveyance. In the following, also with respect to the areas P2 to P5, the control portion 90 determines whether each area has reached the curling correction portion 60 based on the amount of conveyance of the print sheet P.

In the next step S17, the control portion 90 determines whether the density value of the area P1 obtained in step S15 is greater than or equal to the reference value determined in advance. Here, upon determining that the density value is greater than or equal to the reference value, the control portion 90 shifts the process to the step S18. On the other hand, upon determining that the density value is less than the reference value, the control portion 90 shifts the process to step S19.

In step S18, the control portion 90 changes a set value of the conveyance speed of the print sheet P to the first speed V1. Specifically, the control portion 90 supplies a control signal to the motor driver 97 to drive the hard roller rotation motor 75 such that the conveyance speed of the print sheet P becomes the first speed V1. For example, in a case where the density value of the area P1 is greater than or equal to the reference value, the print sheet P is conveyed at the first speed V1 (see FIG. 8A) when the area P1 passes through the curling correction portion 60. Here, the first speed V1 is a set speed determined in advance corresponding to a density value that is greater than the reference value. If the density value of an image is large, the magnitude of curling of the print sheet P is also large. If the density value of an image is small, the magnitude of curling of the print sheet P is also small. Therefore, the conveyance speed of the print sheet P passing through the curling correction portion 60 is defined to a speed at a level where the curling can be corrected.

In step S19, the control portion 90 changes the set value of the conveyance speed of the print sheet P to the second speed V2 which is faster than the first speed V1. Specifically, the control portion 90 supplies a control signal to the motor driver 97 to drive the hard roller rotation motor 75 such that the conveyance speed of the print sheet P becomes the second speed V2. Accordingly, when the area P1 passes through the curling correction portion 60, the print sheet P is conveyed at the second speed V2. The second speed V2 is a set speed determined in advance corresponding to a density value that is smaller than the reference value. Here, the faster the conveyance speed in the curling correction portion 60 is, the smaller the degree of correction of curling is. The slower the conveyance speed is, the greater the degree of correction of curling is. Therefore, in the present embodiment, the first speed V1, which is set when the magnitude of curling is large (when the density value is high), is set to be a speed slower than the second speed V2. It should be noted that the control portion 90 which changes the conveyance speed of the print sheet P in step S18 and S19 is one example of a speed control portion of the present disclosure.

In the present embodiment, when the set value of the conveyance speed of the print sheet P is changed to the first speed V1 or the second speed V2 in step S18 or S19, the conveyance speed of the print sheet P by the fixing portion 19 and discharge roller pairs 23 is also changed to the same speed. Accordingly, no difference will be caused between the conveyance speeds, and thus, the print sheet P can be smoothly conveyed in the conveyance path 28.

Upon completion of the processes of steps S18 or S19, the control portion 90 shifts the process to step S20. In step S20, the control portion 90 determines whether the next area Pk (k=2, 3, 4, 5) has reached the curling correction portion 60. Upon determining that the next area Pk has reached the curling correction portion 60, the control portion 90 repeats the processes of step S17 and thereafter. That is, the control portion 90 determines whether the density value of the next area Pk is greater than or equal to the reference value, and when the density value is greater than or equal to the reference value, the control portion 90 causes the print sheet P to be conveyed at the first speed V1, and when the density value is less than the reference value, the control portion 90 causes the print sheet P to be conveyed at the second speed V2. The control portion 90 repeats such process for each of the areas P1 to P5. For example, when the density value of the area P3 is less than the reference value, the control portion 90 causes the print sheet P to be conveyed at the second speed V2 when the area P3 passes through the curling correction portion 60 (see FIG. 8B).

In step S21, the control portion 90 determines whether the area P5 on the trailing end side of the print sheet P in the conveying direction has passed through the curling correction portion 60 (see FIG. 8C). Upon determining that the area P5 has passed through the curling correction portion 60, the control portion 90 returns the conveyance speed of the print sheet P at the curling correction portion 60 to a standard speed V0 before the change was made, and causes the hard roller 61 to rotate at the standard speed V0.

As described above, in the image forming apparatus 10 according to the present embodiment, the curling correction portion 60 is positioned at a position (the first position or the second position) at which the curling correction portion 60 can correct curling occurring in the print sheet P after image formation, based on the direction of the curling. Therefore, irrespective of the direction and the magnitude of the curling of the print sheet P, the curling can be appropriately and assuredly corrected. Moreover, the conveyance speed of the print sheet P passing through the curling correction portion 60 is set in accordance with the magnitude of the curling occurring in the print sheet P. That is, when the magnitude of the curling is large, the conveyance speed is set to a slow speed (the first speed V1), and when the magnitude of the curling is small, the conveyance speed is set to a fast speed (the second speed V2). Therefore, this prevents insufficient correction from being made, and prevents a situation from occurring where too much correction is made onto the print sheet P to make it curl to a reverse direction. Thus, the curling that has occurred in the print sheet P can be assuredly removed.

In the embodiment described above, an example has been described in which the areas P1 to P5 of the print sheet P are set, and the conveyance speed of the print sheet P is changed for each area. However, the present disclosure is not limited thereto. For example, the print sheet P is divided into less than five areas or into six or more areas, and the conveyance speed of the print sheet P may be changed for each of the areas. Further, without setting division areas in the print sheet P, the conveyance speed of the print sheet P may be changed based on the density value of the entire area of each of the first surface and the second surface. Further, without performing determination in step S17 for each area, the density value in the image formation surface is always compared with the reference value to make determination, and the conveyance speed of the print sheet P in the curling correction portion 60 may be changed in real time in accordance with the result of the determination.

In the embodiment described above, an example has been described in which the conveyance speed of the print sheet P to be conveyed in the curling correction portion 60 is set to either one of the first speed V1 and the second speed V2. However, the present disclosure is not limited thereto. Two or more of the reference values and three or more set speeds are determined in advance, and the conveyance speed of the print sheet P may be changed to one set speed selected from the plurality of set speeds, in accordance with the density value.

In the embodiment described above, an example has been described in which, in the second surface printing, the conveyance speed is set without taking into consideration the density of each area on the back side (first surface) on which image formation has been performed. However, the present disclosure is not limited thereto. For example, in the second surface printing, the image density in each area on the first surface and the image density of each area on the second surface are compared with each other, and based on the difference between the densities, the conveyance speed may be set. Specifically, now, a case is considered where the print sheet P curls toward the second surface side in the case of the second surface printing. In this case, in the flow chart in FIG. 7, when the second surface printing is performed, the curling correction portion 60 is always positioned at the second position. In such a configuration, for example, the area of the first surface that corresponds to the area P1 on the second surface printing is the area P5. Thus, in the second surface printing, in a case where the density difference between the density of the area P1 of the second surface and the density of the area P5 of the first surface is greater than or equal to a predetermined threshold value, the conveyance speed by the curling correction portion 60 may be reduced, and in a case where the density difference is less than the predetermined threshold value, the conveyance speed by the curling correction portion 60 may be increased. Also with this configuration, curling in the print sheet P can be assuredly removed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image forming portion configured to transfer a toner image onto a recording medium;

a fixing portion configured to fix the toner image, transferred by the image forming portion, onto the recording medium;

a curling correction portion disposed downstream of the fixing portion in a conveying direction of the recording medium, and having one pair of rollers composed of members that respectively have different elasticities and are pressed against each other, the curling correction portion configured to correct curling that has occurred in the recording medium after the toner image was fixed thereto by the fixing portion, by conveying the recording medium sandwiched with the roller pair; and a speed control portion configured to change a conveyance speed of the recording medium by the roller pair based on a density value of the toner image on the recording medium.

2. The image forming apparatus according to claim 1, wherein when the density value of the image on the recording medium is greater than or equal to a reference value, the speed control portion changes the conveyance speed by the roller pair to a first speed determined in advance, and when the density value of the image on the recording medium is less than the reference value, the speed control portion changes the conveyance speed by the roller pair to a second speed faster than the first speed.

3. The image forming apparatus according to claim 1, further comprising:

a density obtaining portion configured to obtain a density value of an image of each of a plurality of division areas obtained by dividing, into the plurality of division areas, an image formation surface of the recording medium to which the toner image has been fixed by the fixing portion, from an end portion thereof on a downstream side in a conveying direction by the roller pair of the curling correction portion toward an end portion on an upstream side thereof, wherein based on the density value of the toner image of each division area obtained by the density obtaining portion, the speed control portion changes the conveyance speed when the division area is conveyed by the roller pair.

4. The image forming apparatus according to claim 1, wherein the curling correction portion is rotatably supported about a rotation shaft so as to be able to reverse arrangement of the rollers of the roller pair, the rotation shaft being parallel to shafts of the rollers, the image forming apparatus further comprising:

a drive portion configured to rotate the curling correction portion;

a curling direction determination portion configured to determine a direction of curling of the recording medium after image formation; and a rotation control portion configured to control drive of the drive portion, to rotate the curling correction portion to a position at which the curling correction portion is capable of correcting the curling into a direction reverse to the direction of curling determined by the curling direction determination portion.

5. The image forming apparatus according to claim 1, further comprising:

a reverse conveyance portion configured to convey the recording medium after image formation to the image forming portion, with front and back sides of the recording medium reversed, in order to form images on both sides of the recording medium, wherein the speed control portion changes the conveyance speed of the recording medium by the roller pair, based on a density difference between density values of images on both sides of the recording medium.

6. The image forming apparatus according to claim 1, wherein the roller pair is composed a soft roller formed from a flexible material and a hard roller formed from a material harder than that of the soft roller.

* * * * *